US011976469B2

(12) United States Patent
Chien

(10) Patent No.: US 11,976,469 B2
(45) Date of Patent: May 7, 2024

(54) DRY CLADDING CLAMP

(71) Applicant: Hsing-Mei Chien, Tainan (TW)

(72) Inventor: Hsing-Mei Chien, Tainan (TW)

( * ) Notice: Subject to any disclaimer, the term of this patent is extended or adjusted under 35 U.S.C. 154(b) by 0 days.

(21) Appl. No.: 17/864,556

(22) Filed: Jul. 14, 2022

(65) Prior Publication Data

US 2023/0026453 A1 Jan. 26, 2023

(30) Foreign Application Priority Data

Jul. 22, 2021 (TW) ..... 110127030

(51) Int. Cl.
*E04F 13/08* (2006.01)

(52) U.S. Cl.
CPC ..... *E04F 13/0814* (2013.01)

(58) Field of Classification Search
CPC ..... E04F 13/0801; E04F 13/0814; E04F 13/0816; E04F 13/0819
See application file for complete search history.

(56) References Cited

U.S. PATENT DOCUMENTS 4,439,970 A * 4/1984 Rosner ..... E04F 13/0835 52/552
8,979,052 B2 * 3/2015 Uota ..... E04F 13/0801 403/381
2012/0241574 A1 * 9/2012 Uota ..... E04F 13/0846 248/231.81
2013/0183088 A1 * 7/2013 Wilkinson, Jr. ..... F16B 3/00 403/354
2022/0034086 A1 * 2/2022 Bunting ..... E04B 2/7403

FOREIGN PATENT DOCUMENTS

DE 2364224 A1 * 11/1975
DE 4228338 A1 * 10/1993 ..... E04F 13/0807
DE 102004041120 A1 * 3/2006 ..... E04F 13/0816
FR 79221 E * 11/1962

* cited by examiner

*Primary Examiner* — Christine T Cajilig
(74) *Attorney, Agent, or Firm* — BACON & THOMAS, PLLC

(57) ABSTRACT

A dry cladding clamp has a lateral plate, a connection plate, a hanging structure, and a first included angle. The lateral plate has an inner edge and an outer edge disposed opposite each other. The connection plate upright extends from the inner edge of the lateral plate. The hanging structure is disposed at the outer edge of the lateral plate and has an abutting plate and at least one embedding plate. The abutting plate upright extends from the outer edge of the lateral plate. The at least one embedding plate extends from the outer edge of the lateral plate. The first included angle is an obtuse angle defined between the abutting plate and each of the at least one embedding plate.

6 Claims, 16 Drawing Sheets

DRY CLADDING CLAMP

BACKGROUND OF THE INVENTION

1. Field of the Invention

The present invention relates to a clamp, and more particularly to a dry cladding clamp for fixing cladding materials to walls or pillars.

2. Description of Related Art

Cladding materials such as stones and tiles with large areas can be fixed to walls or pillars of buildings by wet constructions such as fixing by cement mortar. In addition, the cladding materials can also be fixed by dry constructions such as hanging by a dry cladding clamp.

A conventional dry cladding clamp has a supporting plate, two jointing plates, two abutting plates, and two embedding plates. The two jointing plates are bent from two lateral edges and extend toward a same direction. The two abutting plates are respectively bent from two edges of the two jointing plates. The two embedding plates are respectively bent from two edges of the two abutting plates and obliquely extend toward each other.

When a cladding material is hanged to the wall of the building via the conventional dry cladding clamp, the supporting plate is connected to the wall via L-shaped fixing members and fasteners. The embedding plates are embedded into embedded holes formed in back of the cladding material in advance. The abutting plates abut against the back of the cladding material. Therefore, the cladding material can be hanged on the wall of the building.

However, in the conventional dry cladding clamp, the jointing plates and the abutting plates are disposed between the embedding plates and the supporting plate. The embedding plates are distant from the supporting plate accordingly and generate a large moment when the weight of cladding material is subjected to the conventional dry cladding clamp. In addition, an acute angle is defined between the abutting plate and the embedding plate bent from the abutting plate. Supporting forces provided by the abutting plate and the embedding plate are concentrated to a specific position therebetween, cannot support the cladding material evenly, and fail to offer a suitable support to the cladding material.

To overcome the shortcomings of the conventional dry cladding clamp, the present invention provides a dry cladding clamp to mitigate or obviate the aforementioned problems.

SUMMARY OF THE INVENTION

The main objective of the present invention is to provide a dry cladding clamp that can fix cladding materials to walls or pillars.

The dry cladding clamp comprises a lateral plate, a connection plate, a hanging structure, and a first included angle. The lateral plate has an inner edge and an outer edge disposed opposite each other. The connection plate upright extends from the inner edge of the lateral plate. The hanging structure is disposed at the outer edge of the lateral plate and has an abutting plate and at least one embedding plate. The abutting plate upright extends from the outer edge of the lateral plate. The at least one embedding plate extends from the outer edge of the lateral plate. The first included angle is an obtuse angle defined between the abutting plate and each of the at least one embedding plate.

The dry cladding clamp in accordance with the present invention can be used to dry hang cladding materials on the walls of the buildings and has the following effects:

1. The hanging structure of the dry cladding clamp having the abutting plate and the embedding plate is a structure with obtuse angles. That is, the embedding plate and the abutting plate extend from the outer edge of the lateral plate toward different directions. When the cladding material is dry hanged via the present invention, the embedding plate is obliquely embedded into the cladding material accompanied with the abutting plate abutting against a back of the cladding material. The embedding plate and the abutting plate of the hanging structure of the present invention provide the cladding material with supporting forces with better distribution and outstanding support and fixation effects.

2. In addition, the embedding plate and the abutting plate are bent from the outer edge of the lateral plate. Compared to the conventional dry cladding clamp, a distance between the embedding plate and the connection plate is shortened to reduce a moment generated by the weight of the cladding material under the premise of a stationary weight of the cladding material.

3. In the dry cladding clamp of the present invention, the connection plate bent from the inner edge of the lateral plate can directly be fixed to the wall by a fastener. The present invention can be fixed to the wall without using L-shaped fixing members and is convenient for construction.

Other objects, advantages, and novel features of the invention will become more apparent from the following detailed description when taken in conjunction with the accompanying drawings.

DETAILED DESCRIPTION OF PREFERRED EMBODIMENTS

Figure 1:
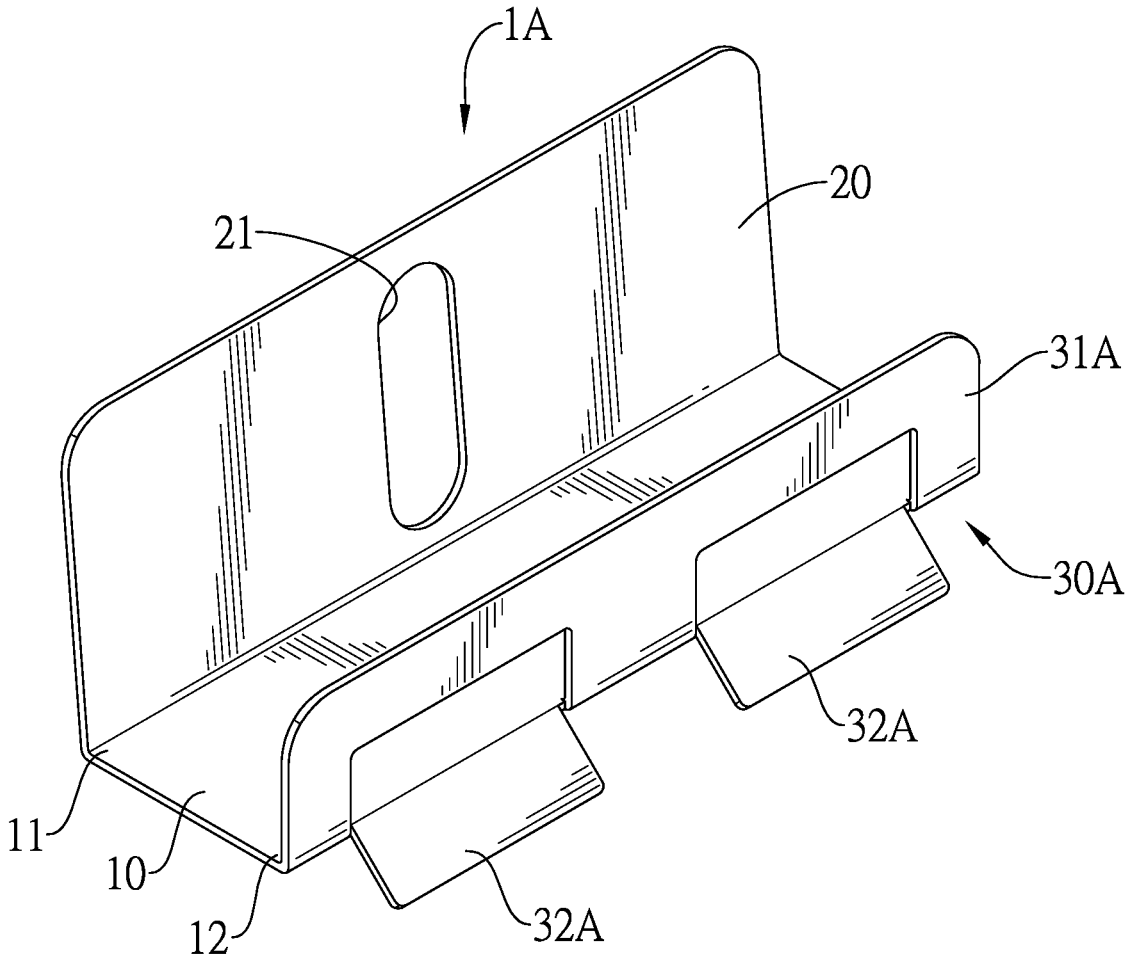
FIG. 1 is a perspective view of a first embodiment of a dry cladding clamp in accordance with the present invention.
Figure 8:
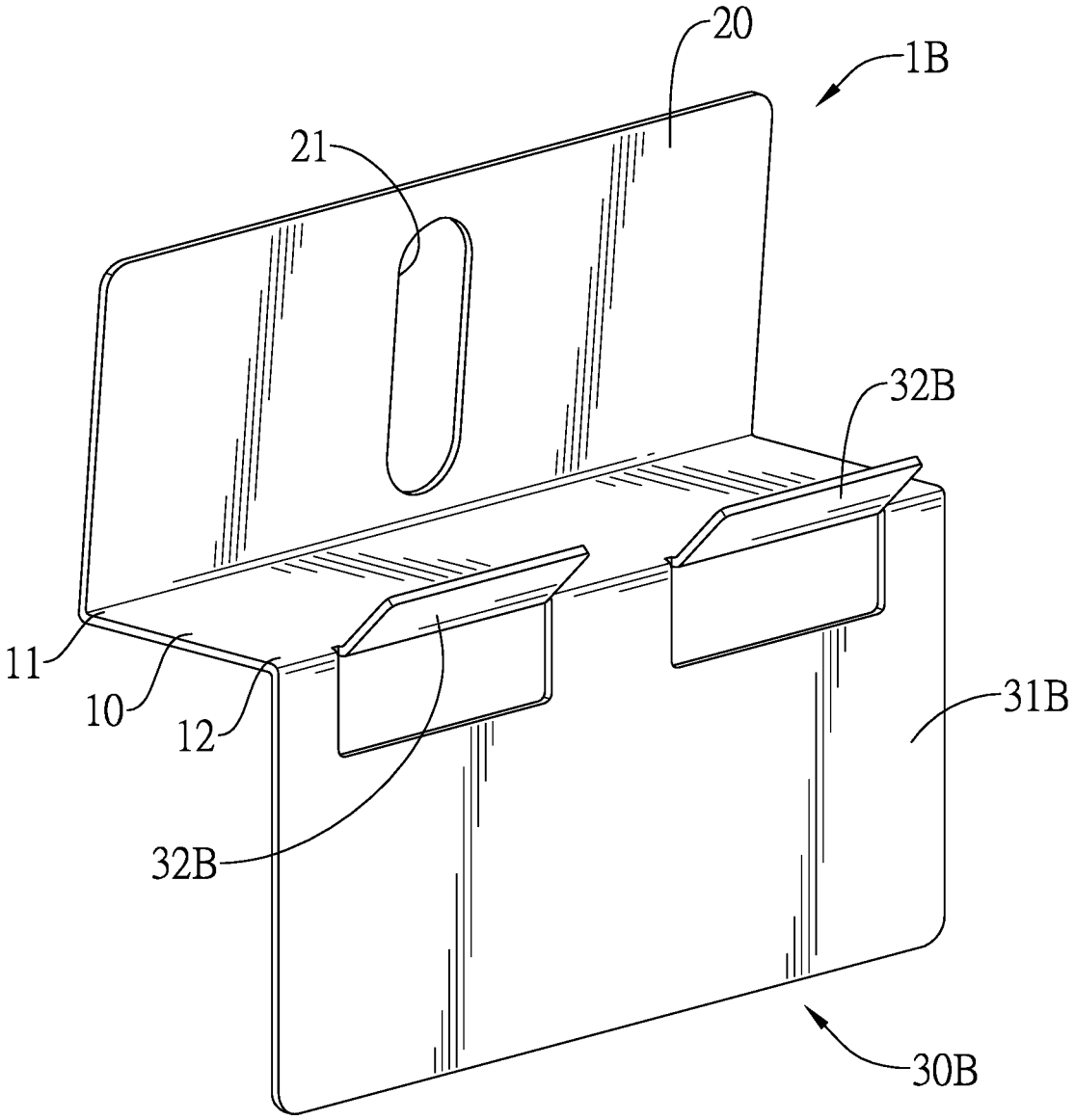
FIG. 8 is a perspective view of a second embodiment of a dry cladding clamp in accordance with the present invention.

With reference to FIGS. 1 and 8, a first embodiment and a second embodiment of the dry cladding clamp 1A, 1B in accordance with the present invention are shown respectively. Each of the two embodiments of the dry cladding clamp 1A/1B has a lateral plate 10, a connection plate 20, and a hanging structure 30A/30B.

With reference to FIGS. 1 to 3 and 8 to 10, the lateral plate 10 is laterally arranged and has an inner edge 11 and an outer edge 12 disposed opposite each other. When the dry cladding clamp 1A/1B is connected to a building and is hanged by a cladding material 3, the inner edge 11 of the lateral plate 10 is toward the building, and the outer edge 12 is disposed away from the building and approaches the cladding material 3.

Figure 4:
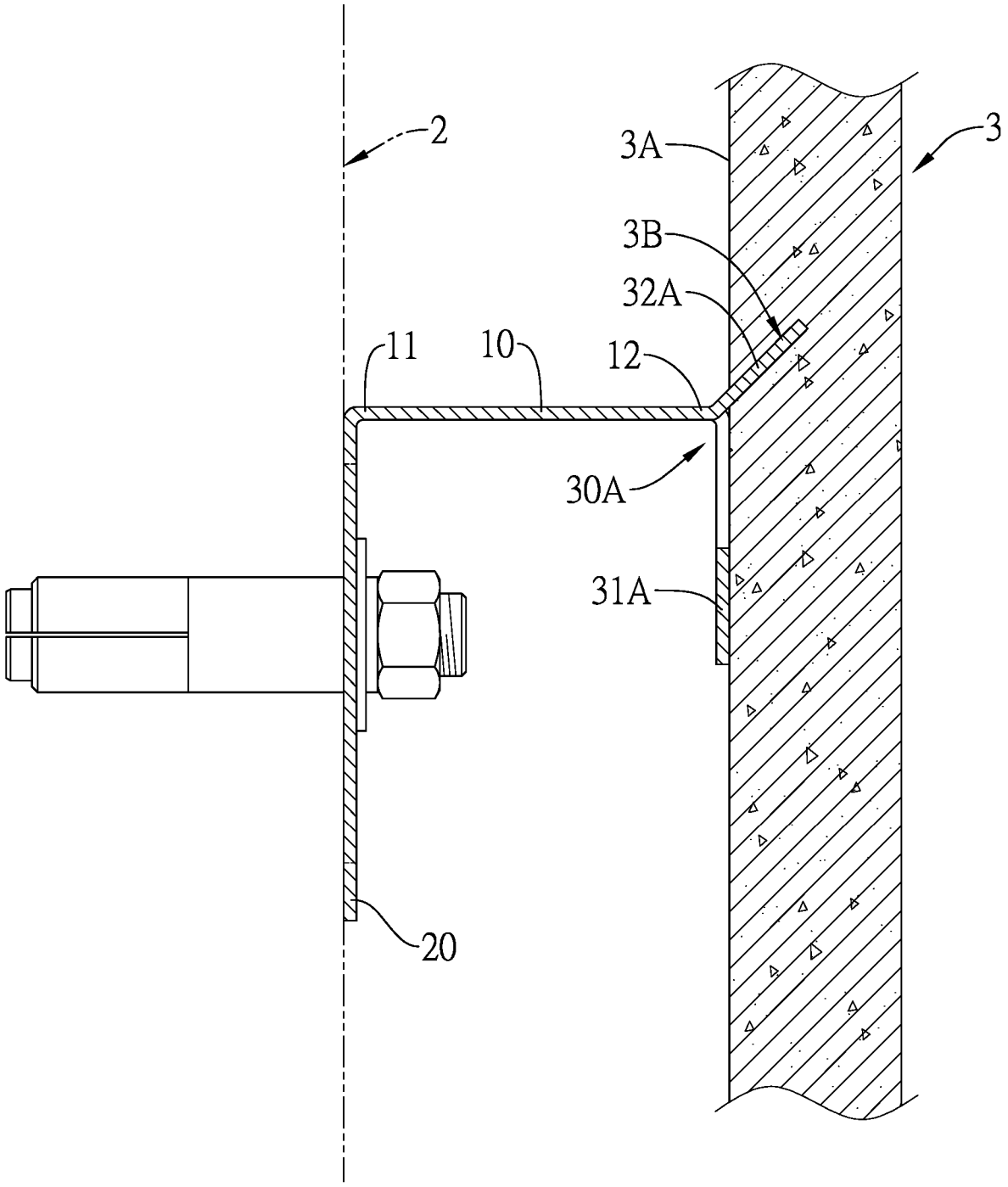
FIG. 4 is a schematic side view of the dry cladding clamp in FIG. 1, showing the dry cladding clamp fixed to a wall and connected to a cladding material.
Figure 5:
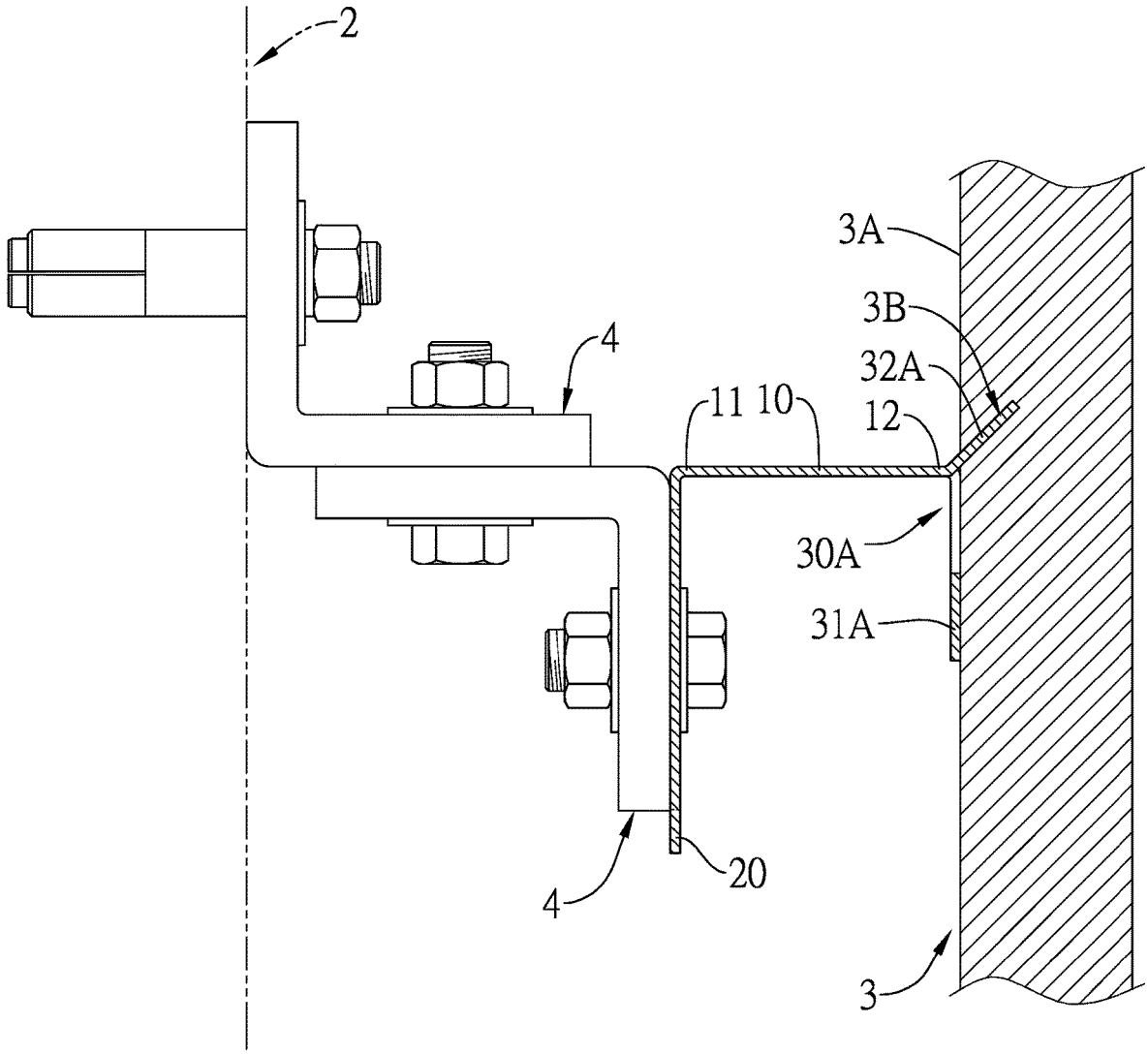
FIG. 5 is a schematic side view of the dry cladding clamp in FIG. 1, showing the dry cladding clamp fixed to the wall via L-shaped fixing members.

With reference to FIGS. 1 to 3 and 8 to 10, the connection plate 20 is bent and upright extends from the inner edge 11 of the lateral plate 10. With reference to FIGS. 1 and 5, a connecting hole 21 is defined through the connection plate 20 and is an elongated hole. The connection plate 20 can be connected to the wall of the building via a fastener mounted through the connecting hole 21. With reference to FIGS. 4 and 5, the connection plate 20 extends downward, when the dry cladding clamp 1A is reversely in use.

With reference to FIGS. 1 to 3 and 8 to 10, the hanging structure 30A/30B is disposed at the outer edge 12 of the lateral plate 10 and has an abutting plate 31A/31B and at least one embedding plate 32A/32B. In the embodiments of the present invention, the at least one embedding plate 32A/32B includes two embedding plates 32A/32B. The abutting plate 31A/31B and the embedding plates 32A/32B are bent and extend from the outer edge 12 of the lateral plate 10. The abutting plate 31A/31B is larger than each embedding plate 32A/32B in length. A first included angle is defined between the abutting plate 31A/31B and each embedding plate 32A/32B. The first included angle is an obtuse angle. A second included angle is defined between the abutting plate 31A/31B and the lateral plate 10. A third included angle is defined between each embedding plate 32A/32B and the lateral plate 10. A fourth included angle is defined between the connection plate 20 and the lateral plate 10. Preferably, the first included angle is larger than or equal to 130 degrees and is smaller than or equal to 140 degrees, the second included angle is larger than or equal to 85 degrees and is smaller than or equal to 95 degrees, and the third included angle is larger than or equal to 130 degrees and is smaller than or equal to 140 degrees.

In the aforementioned embodiments, the connection plate 20 and the abutting plate 31A/31B can be directly bent from a metal plate. The embedding plates 32A/32B can be punched out of the abutting plate 31A/31B and holes with corresponding contours of the embedding plates 32A/32B formed through the abutting plate 31A/31B accordingly. Therefore, the dry cladding clamp 1A/1B can be made by bending and punching the metal plate to be an integral component and facilitates ease in manufacture.

Figure 2:
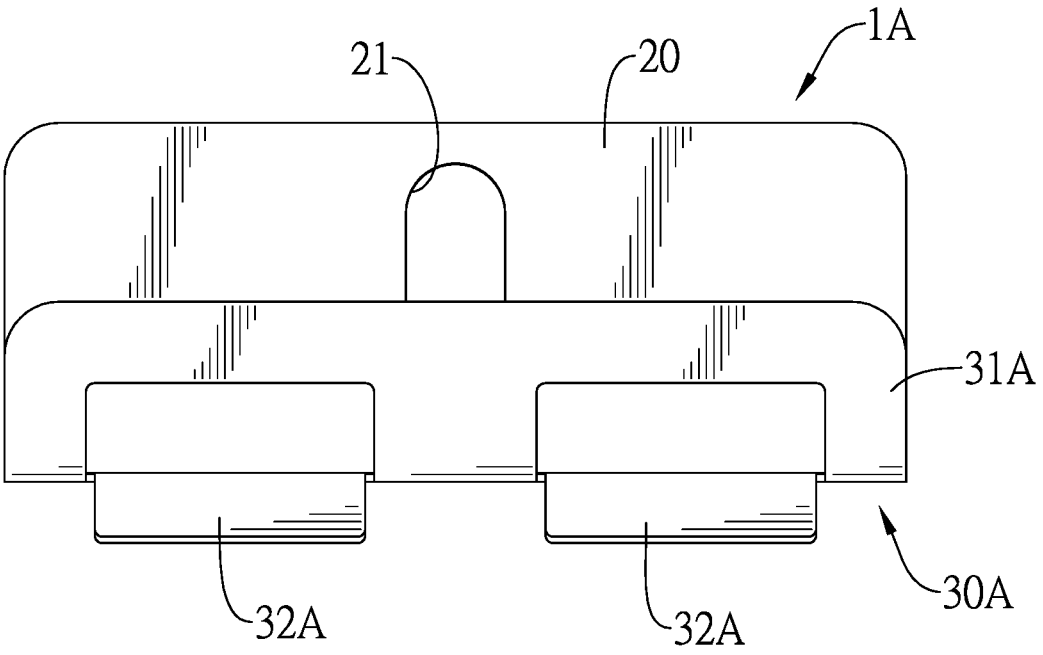
FIG. 2 is a front view of the dry cladding clamp in FIG. 1.
Figure 3:
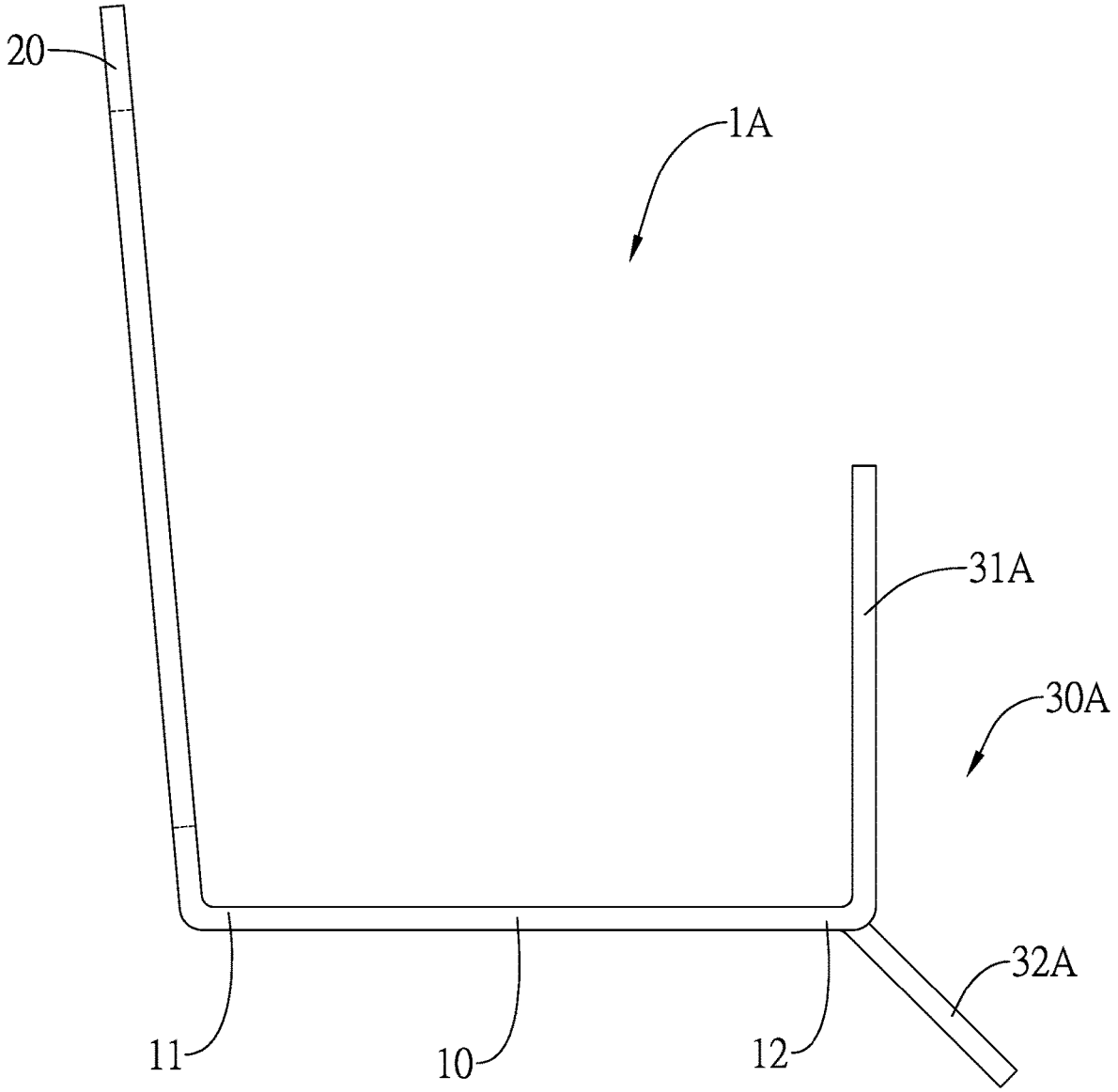
FIG. 3 is a side view of the dry cladding clamp in FIG. 1.

With reference to FIGS. 1 to 3, in the first embodiment of the dry cladding clamp 1A in accordance with the present invention, the abutting plate 31A and the connection plate 20 extend in a same direction and two embedding plates 32B are separately arranged along the outer edge 12 of the lateral plate 10. In the first embodiment, the fourth included angle defined between the connection plate 20 and the lateral plate 10 is smaller than or equal to 90 degrees and is larger than or equal to 95 degrees. Specifically, the fourth included angle between the connection plate 20 and the lateral plate 10 is 95 degrees, the first included angle defined between the abutting plate 31A and each embedding plate 32A is 135 degrees, the second included angle between the abutting plate 32A and the lateral plate 10 is 90 degrees, and the third included angle between each embedding plate 32A and the lateral plate 10 is 135 degrees.

Figure 9:
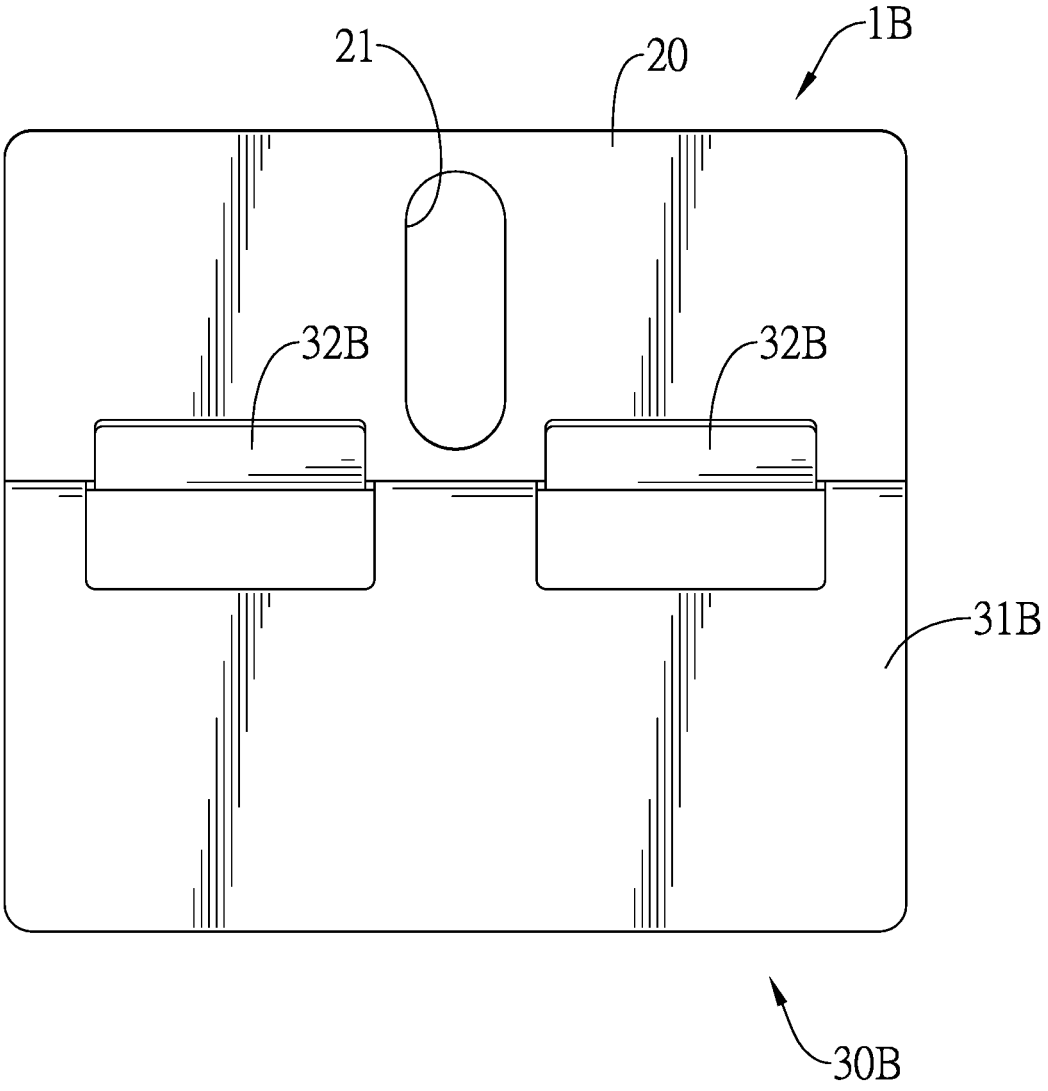
FIG. 9 is a front view of the dry cladding clamp in FIG. 8.
Figure 10:
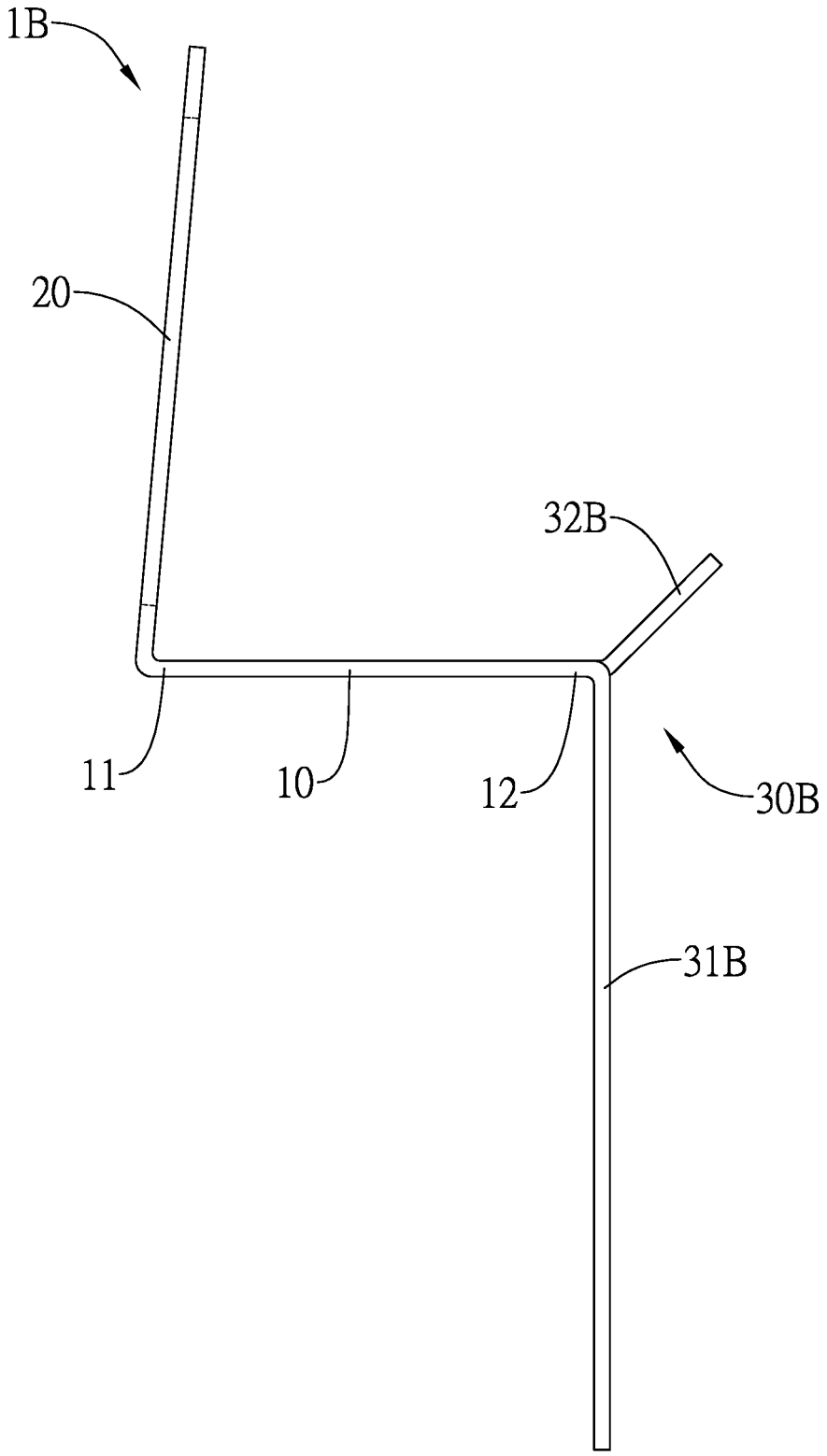
FIG. 10 is a side view of the dry cladding clamp in FIG. 8.

With reference to FIGS. 8 to 10, in the second embodiment of the dry cladding clamp 1B in accordance with the present invention, an extending direction of the abutting plates 31B and an extending direction of the connection plate 20 are different. The hanging structure 30B has two embedding plates 32B separately arranged along the outer edge 12 of the lateral plate 10. In the second embodiment, the fourth included angle defined between the connection plate 20 and the lateral plate 10 is smaller than or equal to 85 degrees and is larger than or equal to 90 degrees. Specifically, the fourth included angle between the connection plate 20 and the lateral plate 10 is 85 degrees, the first included angle defined between the abutting plate 31B and each embedding plate 32B is 135 degrees, the second included angle between the abutting plate 32B and the lateral plate 10 is 90 degrees, and the third included angle between each embedding plate 32B and the lateral plate 10 is 135 degrees.

Figure 11:
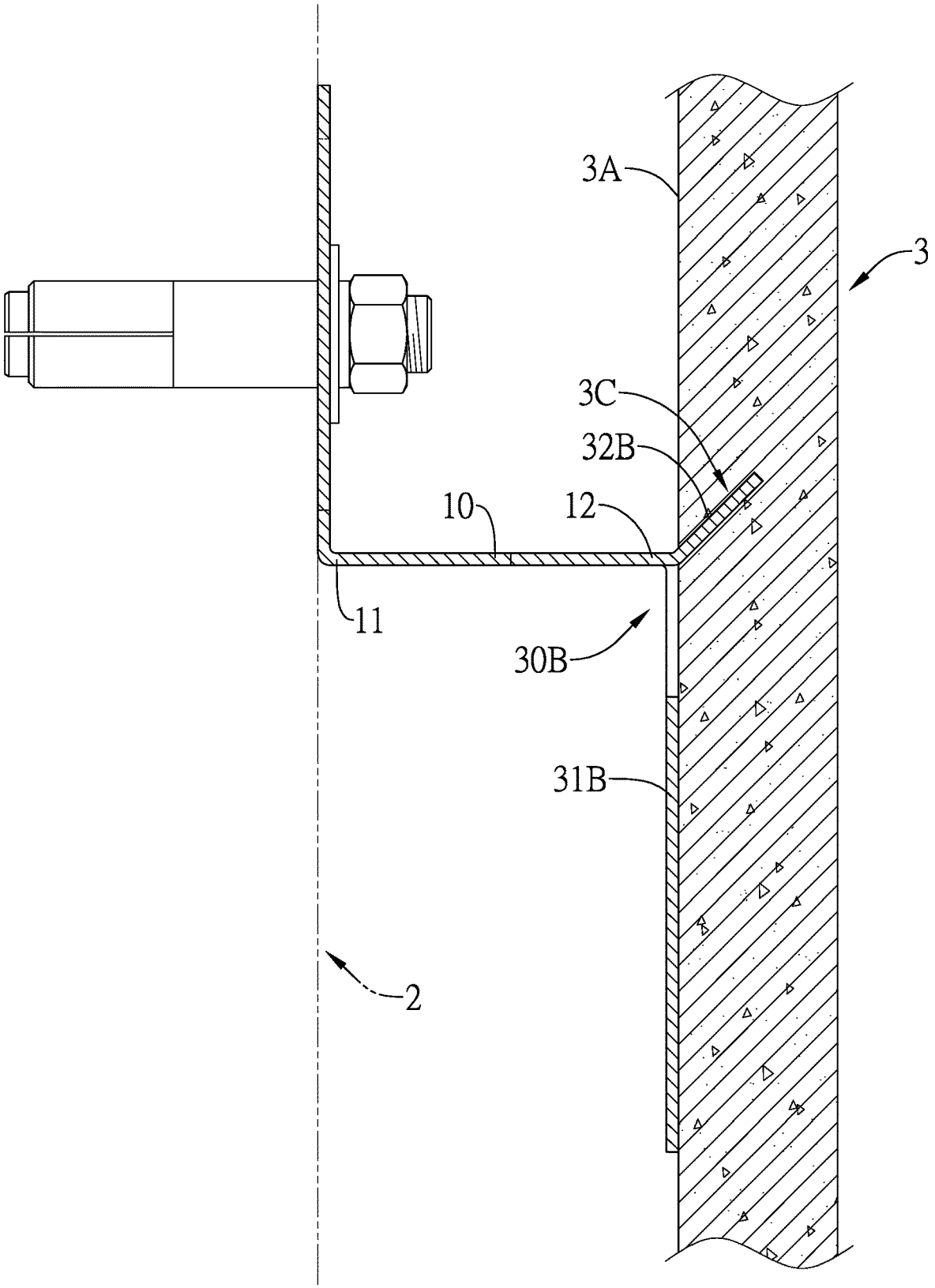
FIG. 11 is a schematic side view of the dry cladding clamp in FIG. 8, showing the dry cladding clamp fixed to the wall and connected to the cladding material.

The cladding material 3 can be connected to a wall 2 via one said dry cladding clamp 1A/1B of the present invention and or can be connected to the wall 2 via two said dry cladding clamps 1A/1B. With reference to FIGS. 4 and 11, when the cladding material 3 is connected to the wall 2 via the single dry cladding clamp 1A/1B, the fastener is mounted through the connecting hole 21 defined through the connection plate 20 and is screwed into and fixed to the wall 2, and the cladding material 3 is dry hanged by the hanging structure 30A/30B disposed at the outer edge 12 of the lateral plate 10. Wherein, embedded holes 3B/3C are obliquely formed in a back 3A of the cladding material 3 in advance. The abutting plate 31A/31B abuts the back 3A of the cladding material 3, and the embedding plates 32A/32B obliquely and upward extend into the embedded holes 3B/3C. The abutting plate 31A/31B and the embedding plates 32A/32B of the hanging structure 30A/30B extend in different directions from the outer edge 12 of the lateral plate 10 and provide the cladding material 3 with supporting forces in better distribution. In addition, the abutting plate 31A/31B and the embedding plates 32A/32B are bent from the outer edge 12 of the lateral plate 10 to decrease a distance defined between the embedding plates 32A/32B embedded in the cladding material 3 and the fastener mounted through the connection plate 20 and to reduce a moment generated by the weight of the cladding material 3 via the dry cladding clamp 1A/1B. Therefore, the dry cladding clamp 1A/1B in accordance with the present invention provides outstanding support and fixation effects.

Figure 12:
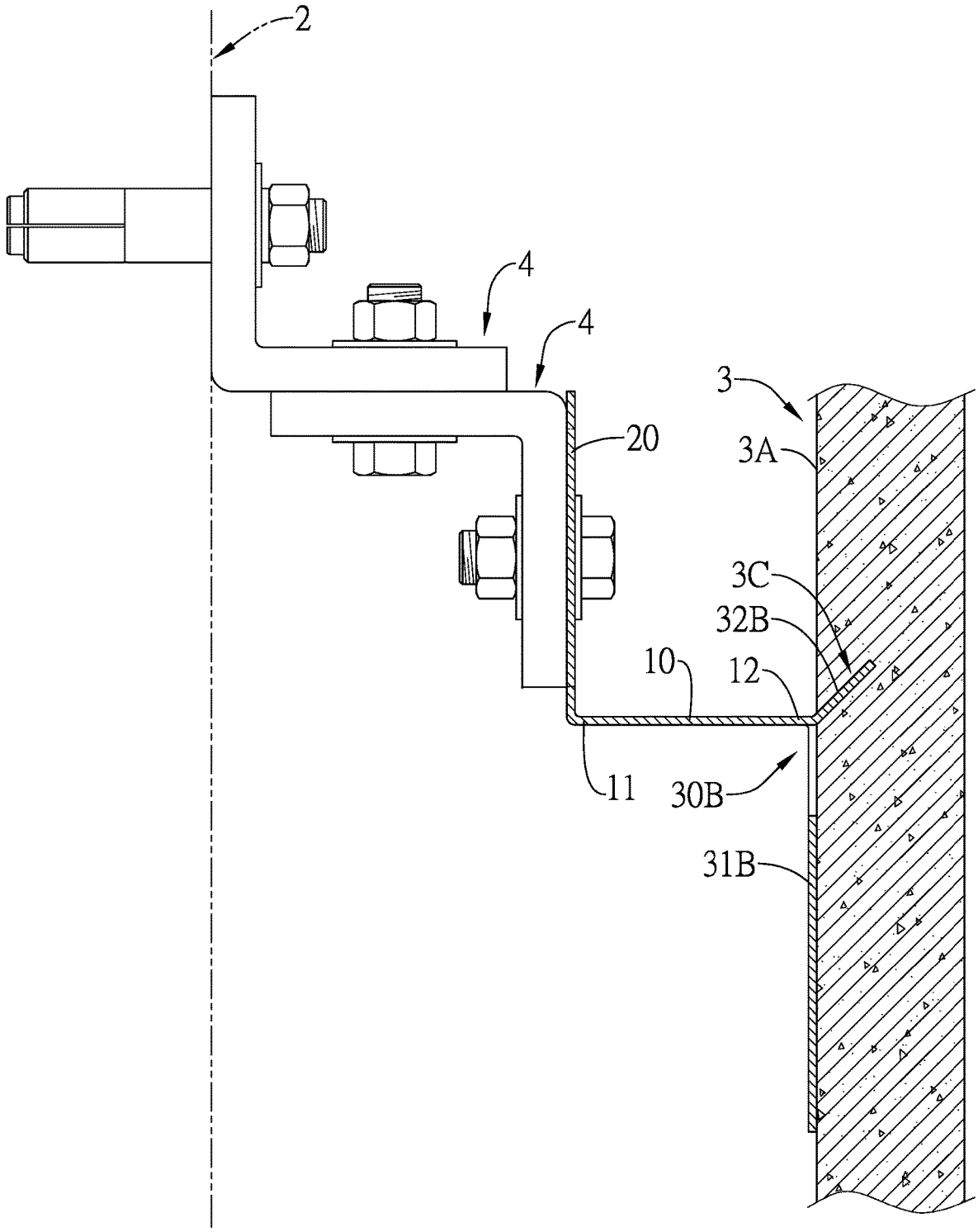
FIG. 12 is a schematic side view of the dry cladding clamp in FIG. 8, showing the dry cladding clamp fixed to the wall via L-shaped fixing members.

In addition, when the cladding material 3 is connected to the wall 2 via a single dry cladding clamp 1A/1B, two L-shaped fixing members 4 can be used with the single dry cladding clamp 1A/1B. With reference to FIGS. 5 and 12, the two L-shaped fixing members 4 are L-shaped. The connection plate 20 of the dry cladding clamp 1A/1B can be connected to the wall 2 via the two L-shaped fixing members 4 and the fasteners.

The cladding material 3 can be connected to the wall 2 via the two dry cladding clamps 1A of the first embodiment or can also be connected to the wall 2 via the two dry cladding clamps 1B of the second embodiment.

Figure 6:
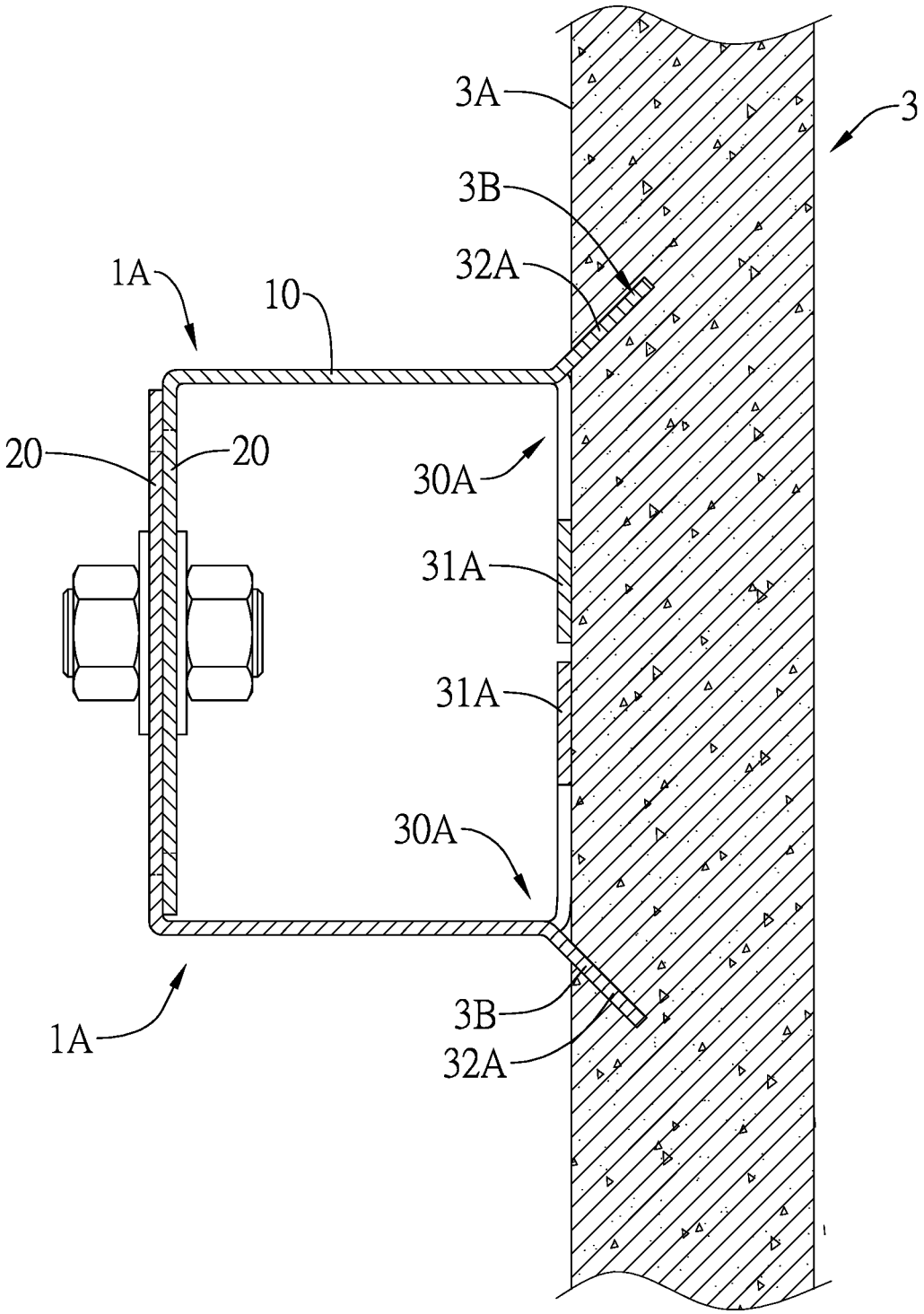
FIG. 6 is a schematic top view of two dry cladding clamps in FIG. 1, showing the two dry cladding clamps connected to a cladding material.
Figure 13:
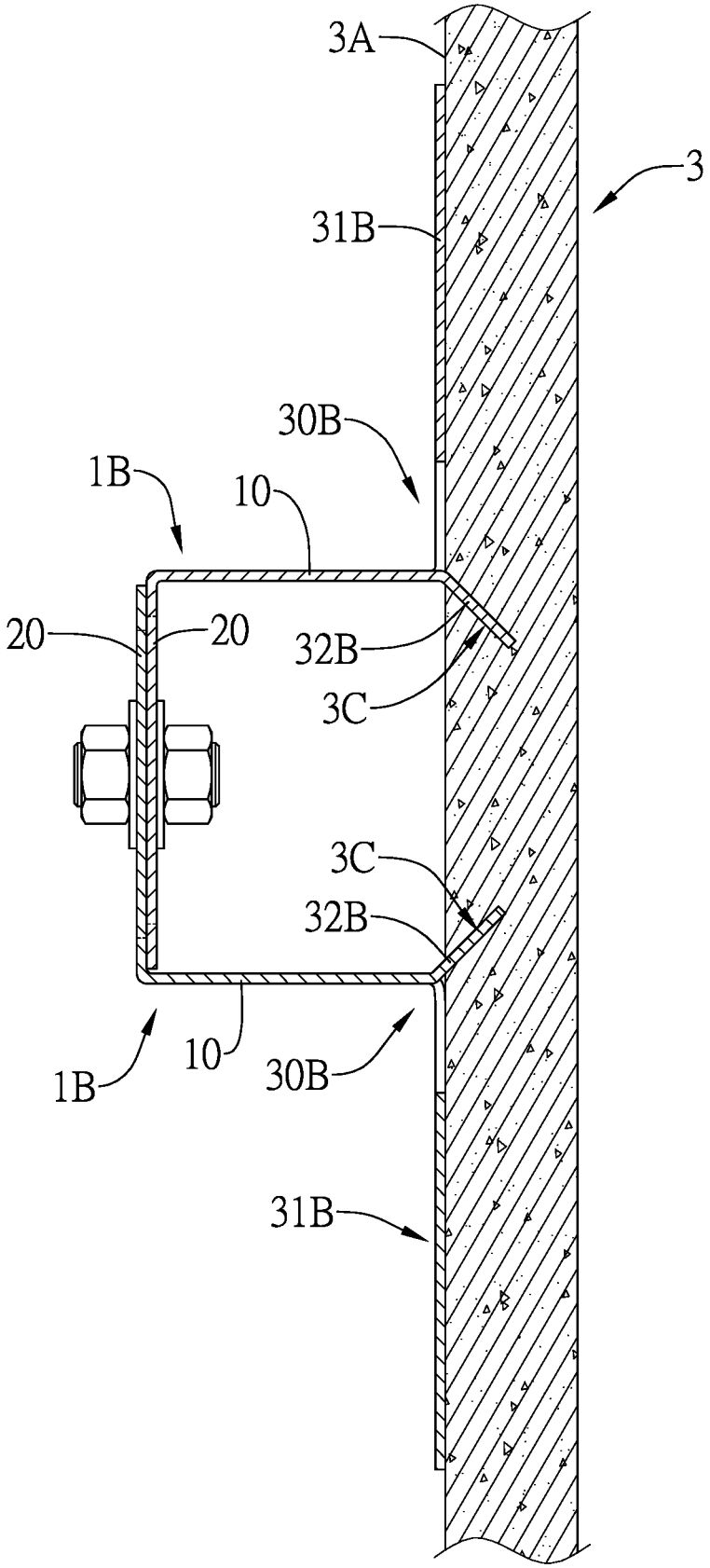
FIG. 13 is a schematic top view of two dry cladding clamps in FIG. 8, showing the two dry cladding clamps connected to a cladding material.

FIG. 6 is a top view showing the cladding material 3 hanged by the two dry cladding clamps 1A of the first embodiment. FIG. 13 is a top view showing the cladding material 3 hanged by the two dry cladding clamps 1B of the second embodiment.

With reference to FIGS. 6 and 13, the two dry cladding clamps 1A/1B are connected together and are disposed opposite in a lateral direction. Wherein, the two connection plates 20 of the two dry cladding clamps 1A/1B are reversely connected to each other via the fastener, the two connection plates 20 are overlapped and abut each other. The two abutting plates 31A/31B of the two hanging structures 30A/30B of the two dry cladding clamps 1A/1B abut the back 3A of the cladding material 3. The embedding plates 32A/32B of the two hanging structures 30A/30B are respectively and obliquely embedded into the embedded holes 3B/3C formed in the back 3A of the cladding material 3.

Figure 7:
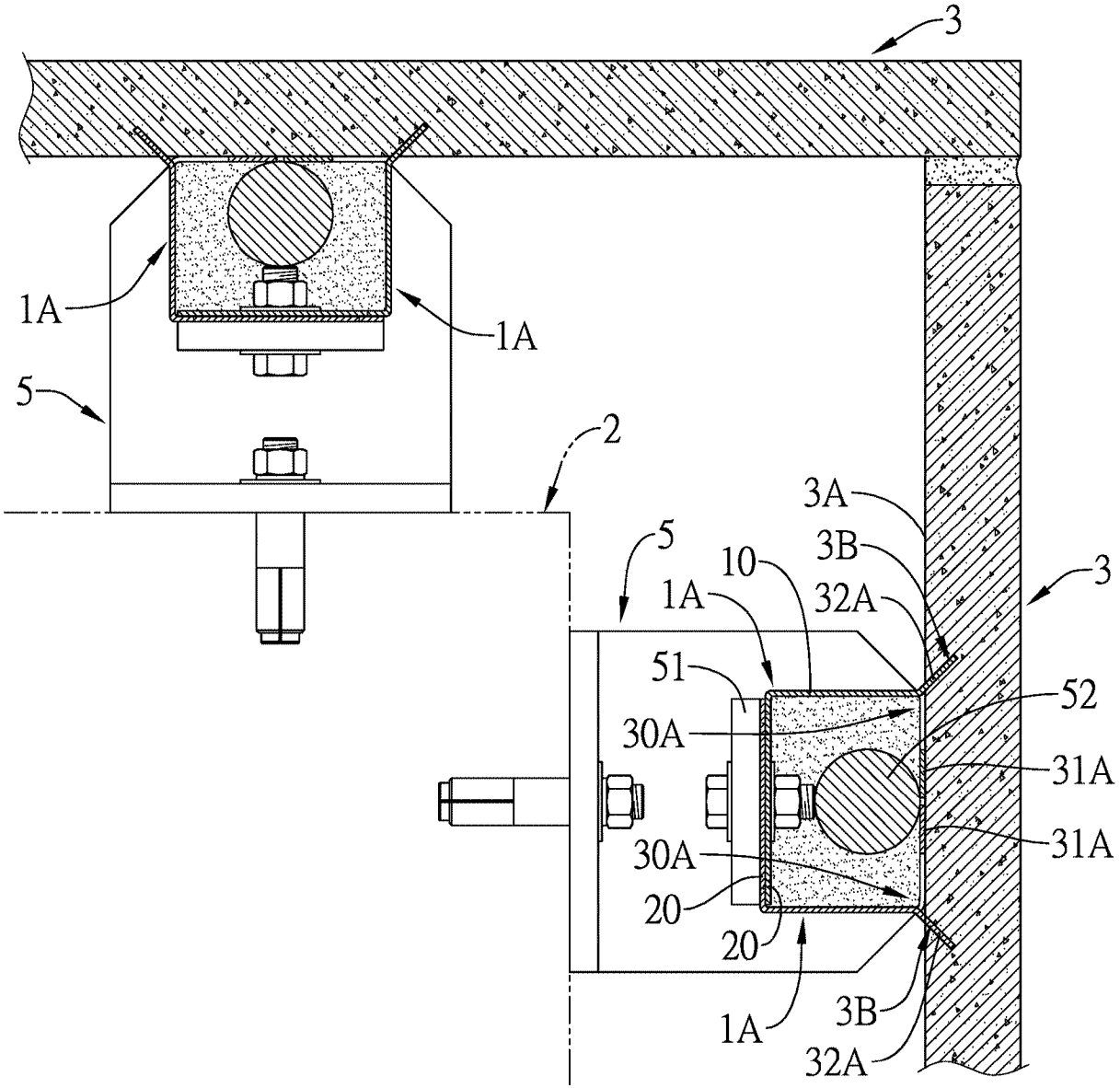
FIG. 7 is a schematic top view of the dry cladding clamp in FIG. 1, showing the dry cladding clamp fixed to the wall via wall fixing members.
Figure 14:
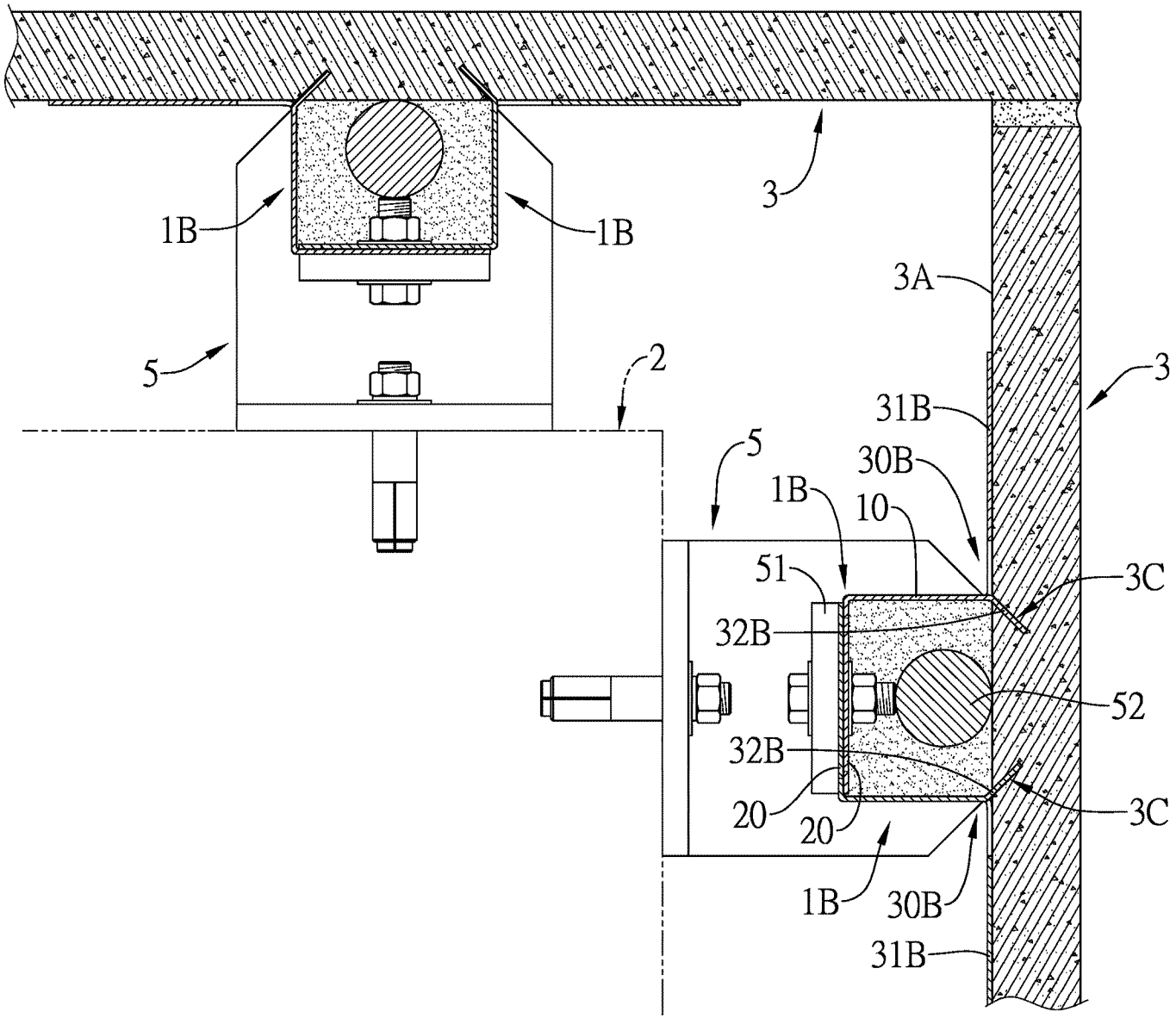
FIG. 14 is a schematic top view of the dry cladding clamp in FIG. 8, showing the dry cladding clamp fixed to the wall via wall fixing members.
Figure 15:
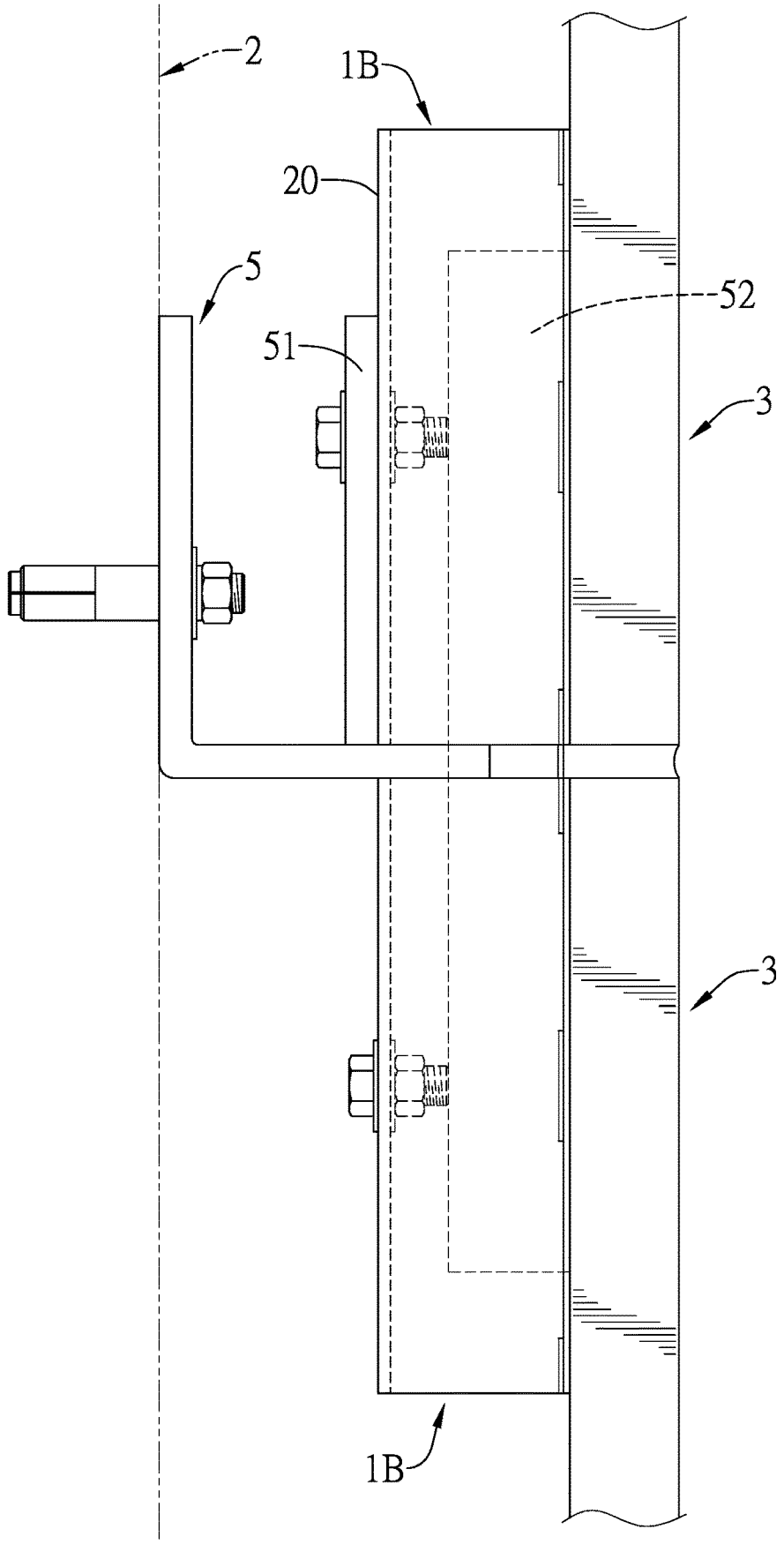
FIG. 15 is a schematic side view of the dry cladding clamp in FIG. 8, showing the dry cladding clamp fixed to the wall via the wall fixing member and connected to the cladding materials.

With reference to FIGS. 6 and 13, a space is surrounded by the two connection plates 20 and the two lateral plates 10 of the two dry cladding clamps 1A/1B. With reference to FIGS. 7, 14, and 15, the space is designed for receiving supporting elements 52 such as a filler and a bar disposed within the filler to facilitate the support of the cladding material 3.

Alternatively, the connection plates 20 of the dry cladding clamp 1A/1B can be directly fixed to the wall 2 by fasteners to provide the cladding material 3 dry hanged on the wall 2 with steady support.

Figure 16:
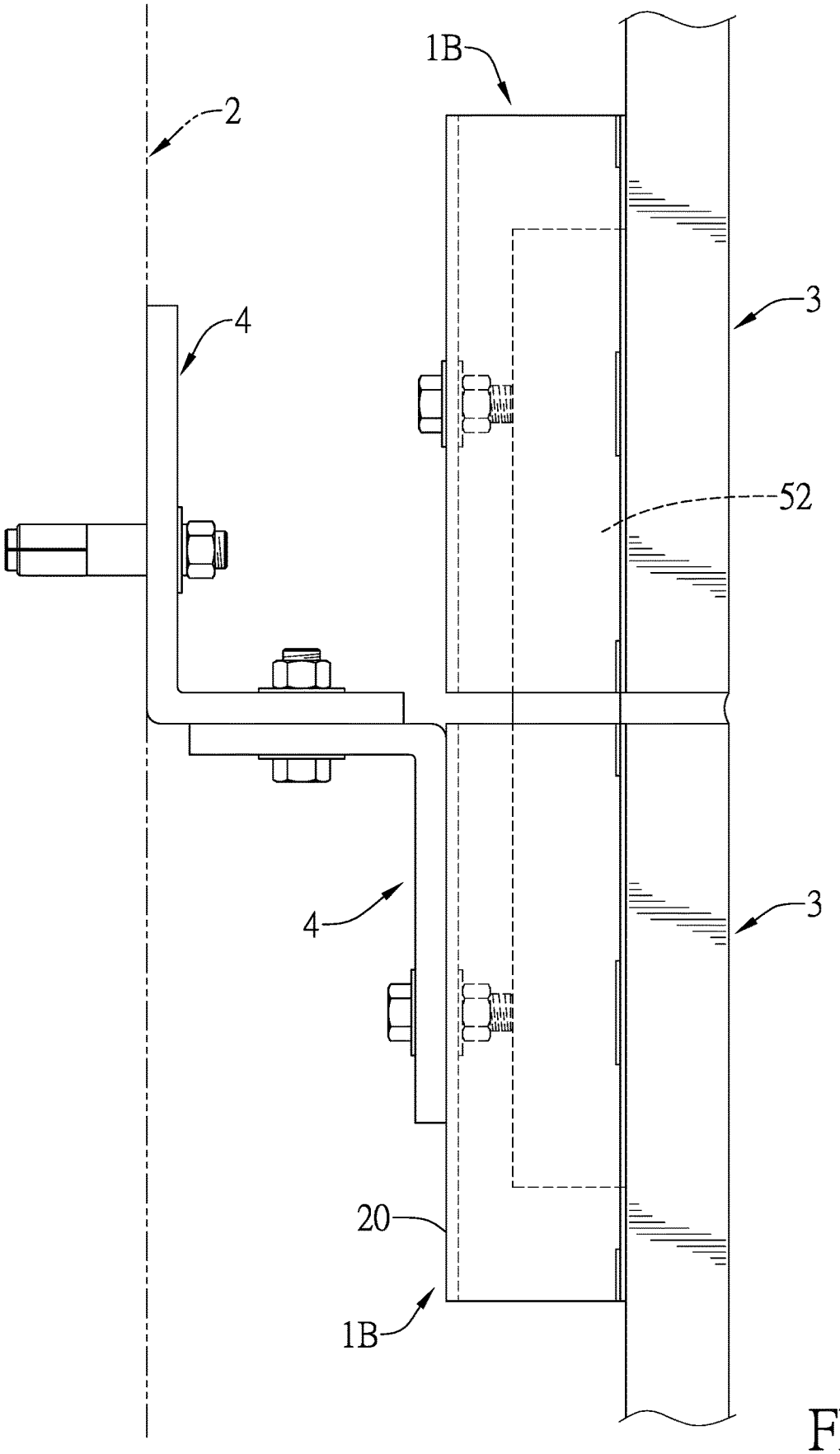
FIG. 16 is a schematic side view of the dry cladding clamp in FIG. 8, showing the dry cladding clamp fixed to the wall via the L-shaped fixing member and connected to the cladding materials.

In addition, the connection plates 20 of the dry cladding clamp 1A/1B can be fixed to the wall 2 via the L-shaped fixing members 4, wall fixing members 5, and the fasteners to steadily support the cladding material 3 dry hanged on the wall 2 as well. With reference to FIGS. 5, 12, and 16, the connection plates 20 of the dry cladding clamp 1A/1B are fixed to the wall 2 via the L-shaped fixing members 4 and the fasteners. With reference to FIGS. 7, 14, and 15, the two connection plates 20 of the dry cladding clamp 1A/1B are fixed to the wall 2 via the wall fixing members 5 and the fasteners.

With reference to FIGS. 7 and 14, each cladding material 3 is dry hanged on the wall 2 via two said dry cladding clamps 1A/1B and one of the wall fixing members 5. The two connection plates 20 of the two dry cladding clamps 1A/1B are connected to a linking plate 51, erectly disposed, of the wall fixing member 5 via one of the fasteners mounted through the two connection plates 20 and the linking plate 51 and screwed into the supporting element 52 with the filler and the bar disposed within the filler. The two the dry cladding clamps 1A/1B connected together and connected by the cladding material 3 can be fixed to the wall 2 via a wall fixing member 5 or via two L-shaped fixing members 4.

With reference to FIG. 15, the two cladding materials 3 are longitudinally dry hanged on the wall 2 via four said dry cladding clamps 1B. The two cladding materials 3 are further distinguished into an upper cladding material 3 and a lower cladding material 3 disposed below the upper cladding material 3. Two of the dry cladding clamps 1B connected to the upper cladding material 3 and the other two of the dry cladding clamps 1B connected to the lower cladding material 3 are opposite in a longitudinal direction. The two dry cladding clamps 1B connected to the upper cladding material 3 are connected to the wall fixing member 5. The two dry cladding clamps 1B connected to the lower cladding material 3 are connected to the above two dry cladding clamps 1B via the supporting element 52. Each of the dry cladding clamp 1B can be connected to the supporting element 52 via the fastener screwed into the supporting element 52. The supporting element 52 having the filler and the bar within the filler provides the cladding material 3 dry hanged on the wall 2 with steady support.

With reference to FIG. 16, two of the dry cladding clamps 1B connected to the lower cladding material 3 are connected to the two L-shaped fixing members 4. The two of the dry cladding clamps 1B connected to the lower cladding material 3 and the other two dry cladding clamps 1B connected to the upper cladding material 3 are connected together via the supporting element 52 as well.

According to the above illustration, the dry cladding clamp 1A/1B in accordance with the present invention has the following effects:

1. The hanging structure 30A/30B of the dry cladding clamp 1A/1B having the abutting plate 31A/31B and the embedding plate 32A/32B is a structure with obtuse angles. When the cladding material 3 is dry hanged via the present invention, the embedding plate 32A/32B is obliquely embedded into the cladding material 3 accompanied with the abutting plate 31A/31B and abuts against the back 3A of the cladding material 3. The embedding plate 32A/32B and the abutting plate 31A/31B of the hanging structure 30A/30B of the present invention provide the cladding material 3 with supporting forces with better distribution and outstanding support and fixation effects.

2. In addition, the embedding plate 32A/32B and the abutting plate 31A/31B are bent from the outer edge 12 of the lateral plate 10. Compared to the conventional dry cladding clamp, a distance between the embedding plate 32A/32B and the connection plate 20 is shortened to reduce a moment generated by the weight of the cladding material 3 under the premise of a stationary weight of the cladding material.

3. In the dry cladding clamp 1A/1B of the present invention, the connection plate 20 bent from the inner edge 11 of the lateral plate 10 can directly be fixed to the wall 2 by the fastener. The present invention can be fixed to the wall 2 without using the L-shaped fixing members 4 or the wall fixing members 5 and is convenient for construction.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A dry cladding clamp comprising:

a lateral plate having an inner edge and an outer edge disposed opposite each other;

a connection plate upright extending from the inner edge of the lateral plate;

a hanging structure disposed at the outer edge of the lateral plate and having an abutting plate upright extending from the outer edge of the lateral plate; and at least one embedding plate extending from the outer edge of the lateral plate; and a first included angle being an obtuse angle defined between the abutting plate and each of the at least one embedding plate;

wherein a free end of each one of the at least one embedding plate protrudes ahead from the abutting plate, and the first included angle is defined between the abutting plate and each of the at least one embedding plate and is larger than or equal to 130 degrees and smaller than or equal to 140 degrees;

a second included angle is defined between the abutting plate and the lateral plate and is larger than or equal to 85 degrees and smaller than or equal to 95 degrees; and a third included angle is defined between each of the at least one embedding plate and the lateral plate and is larger than or equal to 130 degrees and smaller than or equal to 140 degrees.

2. The dry cladding clamp as claimed in claim 1, wherein a fourth included angle is defined between the connection plate and the lateral plate and is larger than or equal to 85 degrees and smaller than or equal to 95 degrees.

3. The dry cladding clamp as claimed in claim 1, wherein the abutting plate and the connection plate extend to a same direction;

the at least one embedding plate includes multiple embedding plates arranged along the outer edge of the lateral plate separately.

4. The dry cladding clamp as claimed in claim 2, wherein the abutting plate and the connection plate extend to a same direction;

the at least one embedding plate includes multiple embedding plates arranged along the outer edge of the lateral plate separately.

5. The dry cladding clamp as claimed in claim 1, wherein the abutting plate and the connection plate extend to different directions;

the at least one embedding plate includes multiple embedding plates arranged along the outer edge of the lateral plate separately.

6. The dry cladding clamp as claimed in claim 2, wherein the abutting plate and the connection plate extend to different directions;

the at least one embedding plate includes multiple embedding plates arranged along the outer edge of the lateral plate separately.

* * * * *